US006305252B1

(12) United States Patent
Hsu

(10) Patent No.: US 6,305,252 B1
(45) Date of Patent: Oct. 23, 2001

(54) TORQUE ENHANCING WRENCH

(76) Inventor: Shin Jong Hsu, 1438 Park Pl., San Marino, CA (US) 91108

( * ) Notice: Subject to any disclaimer, the term of this patent is extended or adjusted under 35 U.S.C. 154(b) by 0 days.

(21) Appl. No.: 09/466,675

(22) Filed: Dec. 20, 1999

(51) Int. Cl.[7] ..... B25B 13/00

(52) U.S. Cl. ..... 81/186; 81/58.2; 81/176.1; 81/125.1

(58) Field of Search ..... 81/186, 58.2, 176.1, 81/125.1

(56) References Cited

U.S. PATENT DOCUMENTS 5,131,312 7/1992 Macor ..... 81/124.3
5,476,024 * 12/1995 Hsieh .
5,595,096 * 1/1997 Coffman .
6,055,890 * 5/2000 Lim .
6,098,501 * 8/2000 Sundstrom .
6,158,309 * 12/2000 Baker .

* cited by examiner

*Primary Examiner*—Timothy V. Eley
*Assistant Examiner*—Willie Berry, Jr.
(74) *Attorney, Agent, or Firm*—Dougherty & Troxell

(57) ABSTRACT

A wrench includes a handle having a head and having an enclosed peripheral wall formed in the head for forming an orifice in the head and for receiving a fastener to be driven by the head. The head includes a pair of opposite cusps extended inward of the orifice and each formed by a pair of inclined surfaces. One of the cusps and the opposite surface may be used to drive the fastener in an active or a reverse direction. The fastener may be rotated relative to the head when the fastener is disengaged from the cusps and the surfaces, without being disengaged from the head.

2 Claims, 5 Drawing Sheets

TORQUE ENHANCING WRENCH

BACKGROUND OF THE INVENTION

1. Field of the Invention

The present invention relates to a wrench, and more particularly to a torque enhancing wrench.

2. Description of the Prior Art

A typical surface conforming torque enhancing wrench is disclosed in U.S. Pat. No. 5,131,312 to Macor and comprise an open end wrench having a number of flat contacting surfaces for engaging with and for driving fasteners or the tool members. The wrench includes an open end for allowing the fasteners to be disengaged from the flat contacting surfaces and to be rotated relative to the wrench body. The fasteners may not be driven by the wrench step by step without being disengaged from the wrench.

The present invention has arisen to mitigate and/or obviate the afore-described disadvantages of the conventional wrenches.

SUMMARY OF THE INVENTION

The primary objective of the present invention is to provide a torque enhancing wrench including a number of flat contacting surfaces for engaging with and for driving a fastener and including an enclosed opening for receiving the fastener and for allowing the fastener to be disengaged from the flat contact surfaces and to be rotated relative to the wrench without being disengaged from the wrench.

In accordance with one aspect of the invention, there is provided a wrench comprising a handle including a first end having a head provided thereon, the head including an enclosed peripheral wall for defining an orifice therein and for receiving a fastener to be driven by the head. The head includes a first cusp and a second cusp extended inward of the orifice thereof and includes a first surface formed beside the first cusp and a second surface formed beside the second cusp for engaging with the fastener. The first cusp and the second surface are provided for driving the fastener in an active direction, and the second cusp and the first surface are provided for driving the fastener in a reverse direction. The fastener is allowed to be rotated relative to the head when the fastener is disengaged from the first and the second cusps and the first and the second surfaces, for allowing the fastener to be driven either in the active direction or in the reverse direction without being disengaged from the head.

The root portion of the head includes a curved surface formed therein having no cusps and flat surfaces formed therein.

The head further includes a third cusp and a fourth cusp extended inward of the orifice of the head and formed between the first and the second cusps, the third cusp is defined by a third and a fourth surfaces, the fourth cusp is defined by a fifth and a sixth surfaces. The first cusp and the second surface and the third surface and the fifth surface are provided for driving the fastener in the active direction, and the second cusp and the first surface and the fourth surface and the sixth surface are provided for driving the fastener in the reverse direction, The head further includes a fifth cusp and a sixth cusp and a seventh cusp extended inward of the orifice of the head and formed between the first and the third cusps, and the third and the fourth cusps, and the fourth and the second cusps respectively, the fifth cusp and the sixth cusp and the seventh cusp each is defined by a pair of surfaces for engaging with and for driving the fastener.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
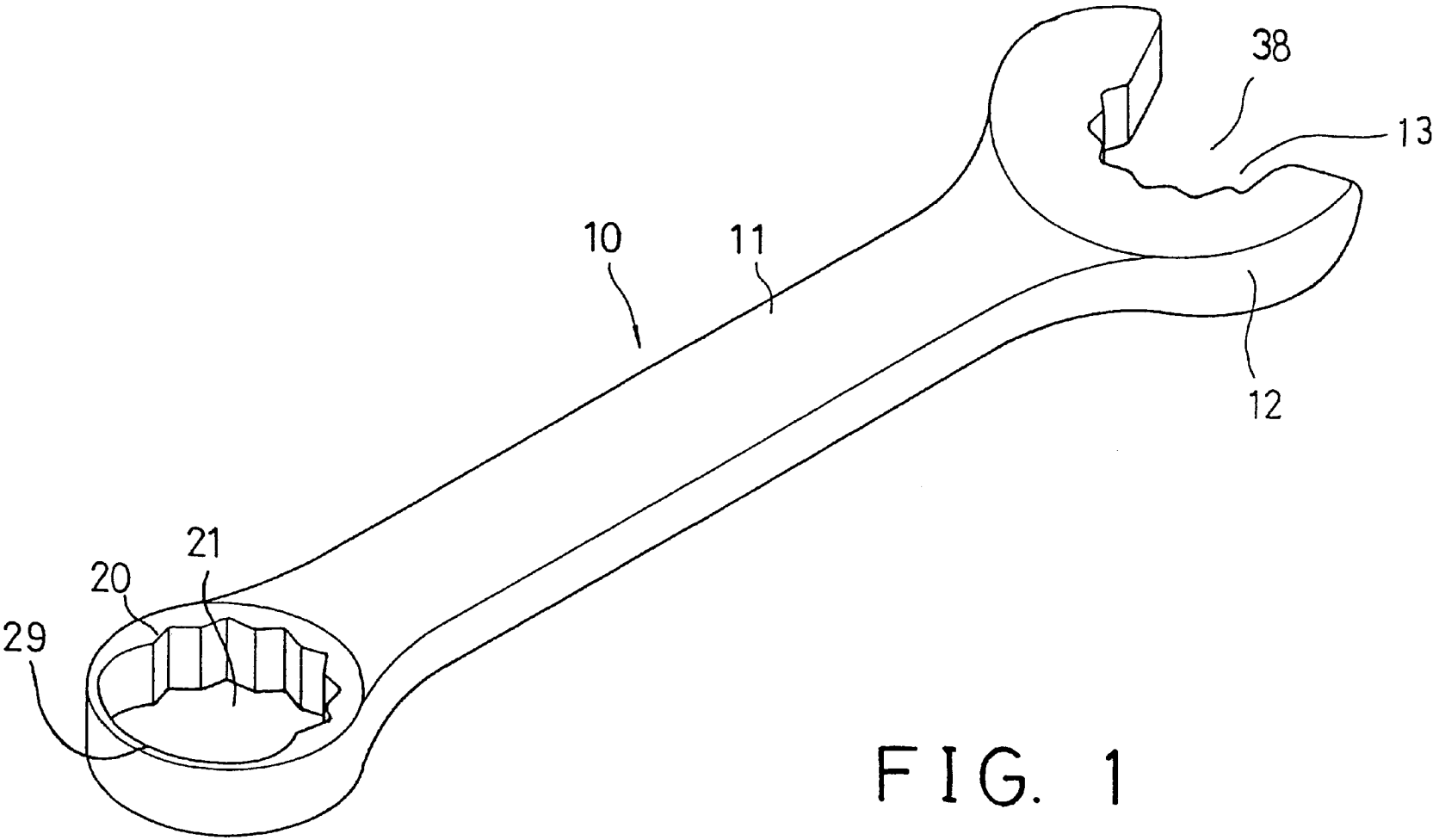
FIG. 1 is a perspective view of a wrench in accordance with the present invention.
Figure 2:
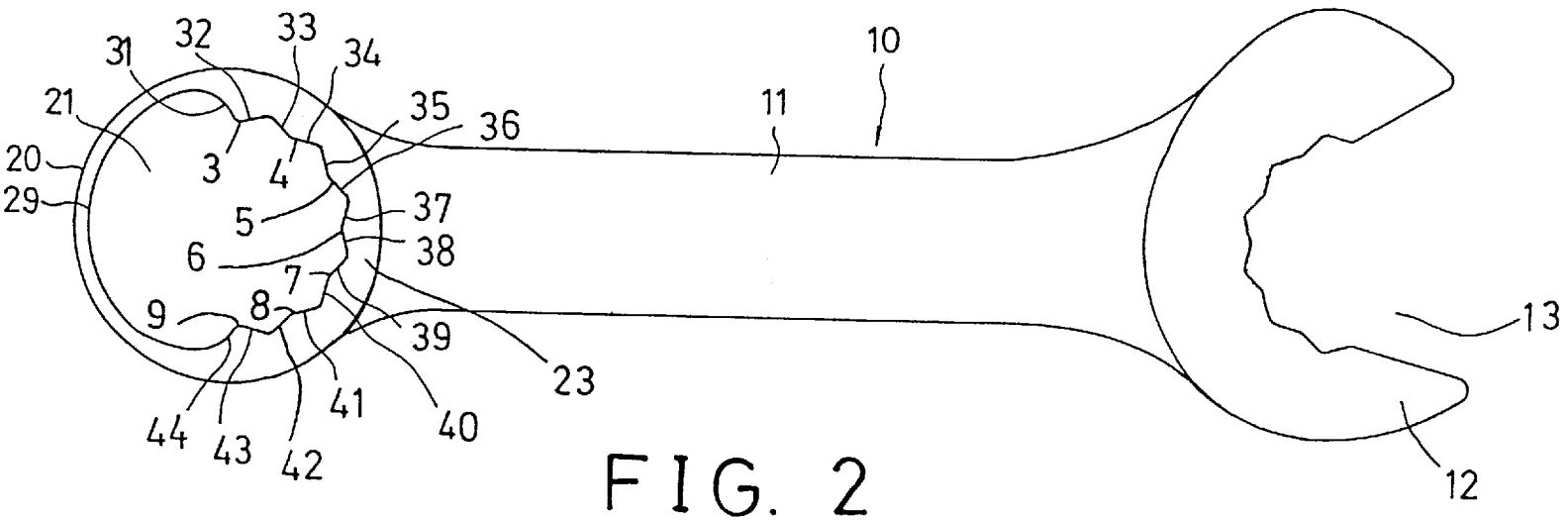
FIG. 2 is a plane view of the wrench.

Referring to the drawings, and initially to FIGS. 1 and 2, a wrench 10 in accordance with the present invention comprises a handle 11 including an opening 13 formed in one end 12 thereof and including an enclosed head 20 formed in the other end thereof. The head 20 includes an orifice 21 formed therein and includes an enclosed peripheral wall 29 for defining the orifice 21 therein and for receiving the fastener 14 (FIGS. 3–7) to be driven by the wrench. The orifice 21 of the head 20 includes a size greater than that of the fastener 14 for allowing the fastener 14 to be rotated relative to the head 20 without being disengaged from the head 20.

Figure 4:
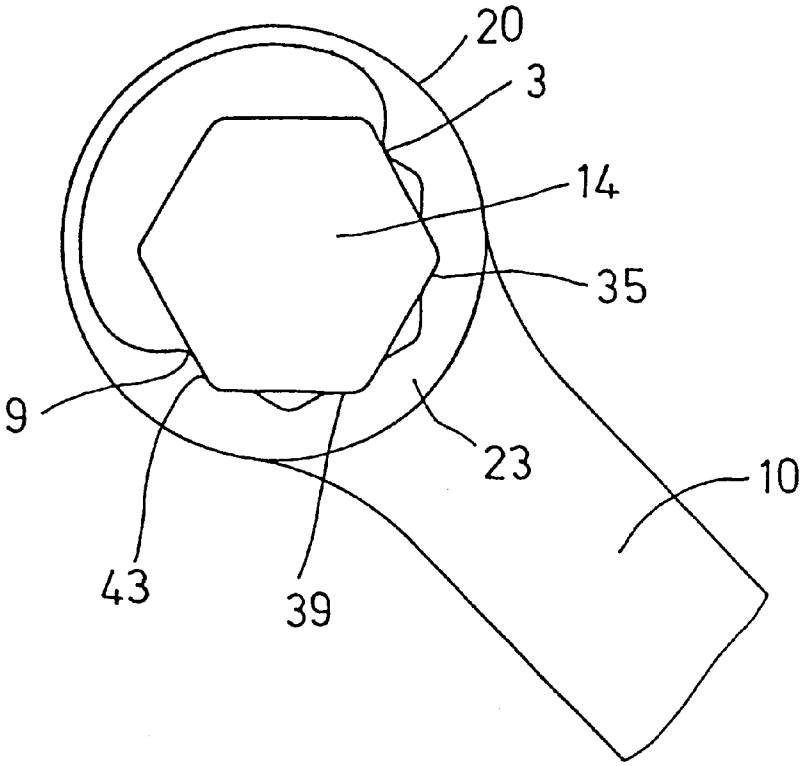
FIGS. 3, 4, 5, 6, 7 are partial plane views illustrating the operation of the wrench.
Figure 3:
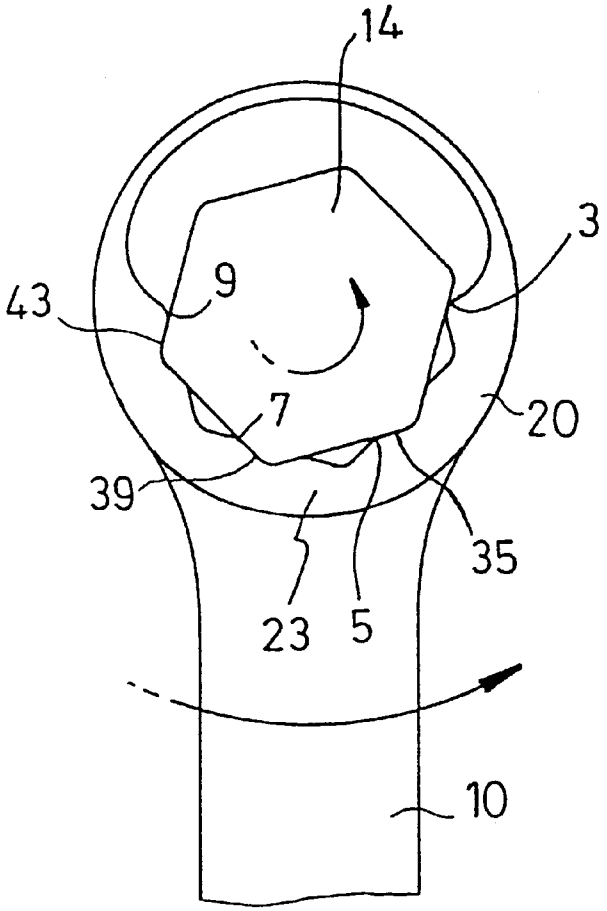
Figure 5:
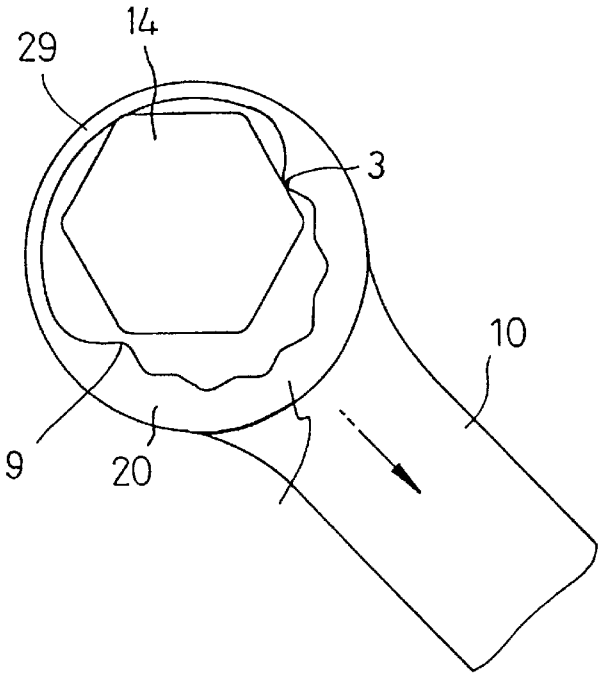
Figure 6:
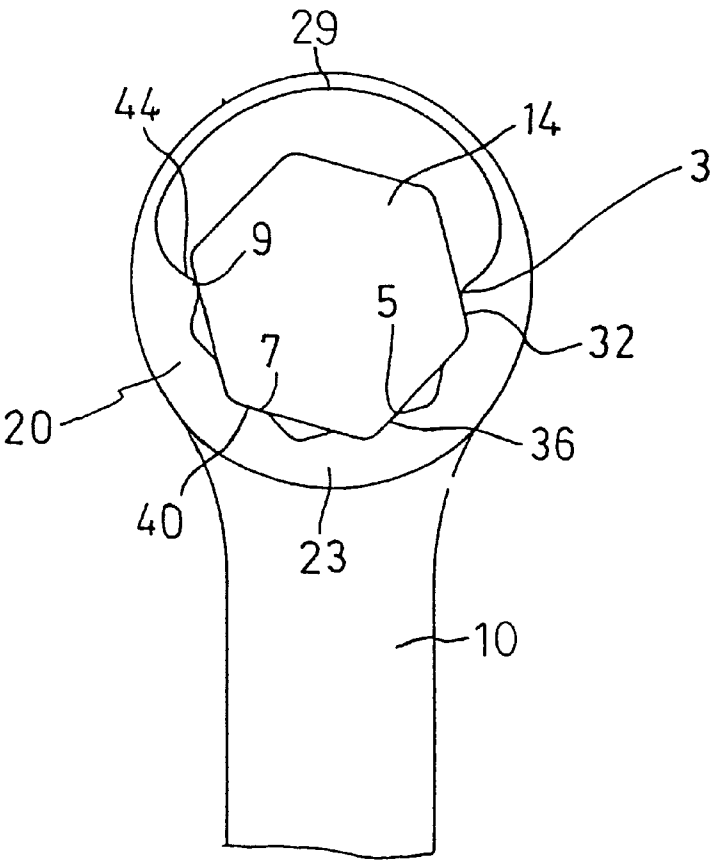
Figure 7:
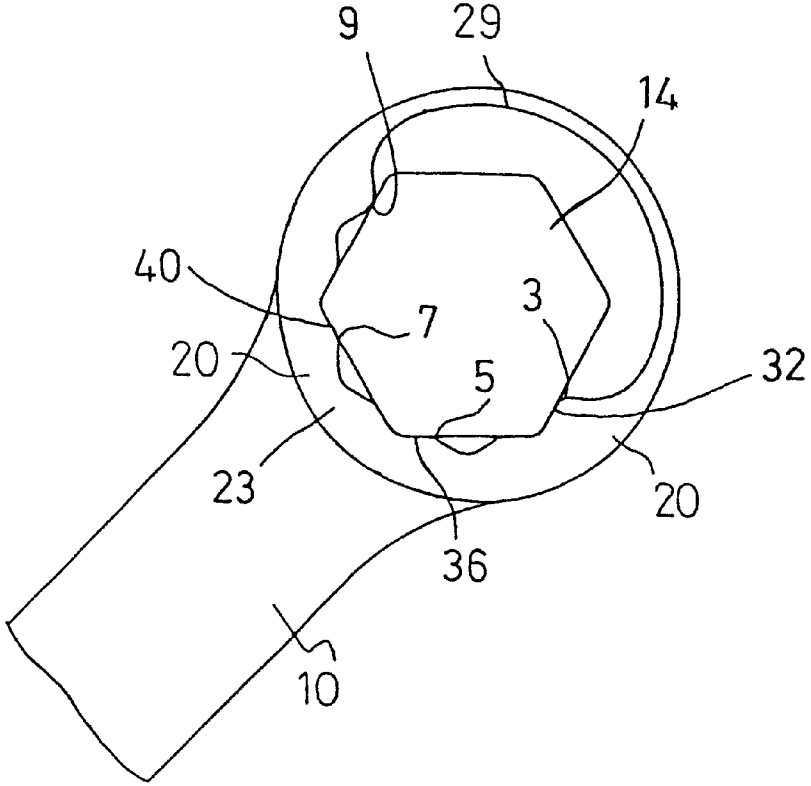

The head 20 includes seven cusps 3, 4, 5, 6, 7, 8, 9 formed in the root portion 23 of the head 20 adjacent to the handle 11 and extending inwardly of the orifice 21 of the head 20 and each defined by a pair of inclined or contacting surfaces 31, 32; 33, 34; 35, 36; 37, 38; 39, 40; 41, 42; 43, 44. Or, the surfaces 32–44 are formed beside the respective cusps 3–9. As shown in FIGS. 3 and 4, the surfaces 35, 39, 43 and the cusp 3 of the head 20 may engage with the fastener 14 for driving the fastener 14 counterclockwise. As shown in FIGS. 6, 7, the surfaces 32, 36, 40 and the cusp 9 of the head 20 may engage with the fastener 14 for driving he fastener 14 clockwise. As shown in FIG. 5, when the head 20 is moved relative to the fastener 14, or, alternatively, when the fastener 14 is moved relative to the head 20 to disengage the cusps 3–9 of the head 20 from the fastener 14, the fastener 14 may be rotated relative to the head 20 without being disengaged from the head 20 and may be forced to engage with the cusps and surfaces again when the fastener 14 is moved toward the cusp, such that the fastener 14 may be rotated in one direction step by step by the wrench without being disengaged from the wrench. The fastener 14 may be solidly driven by the head 20 when the head 20 include the four cusps 3, 5, 7, 9 extended therein.

Figure 8:
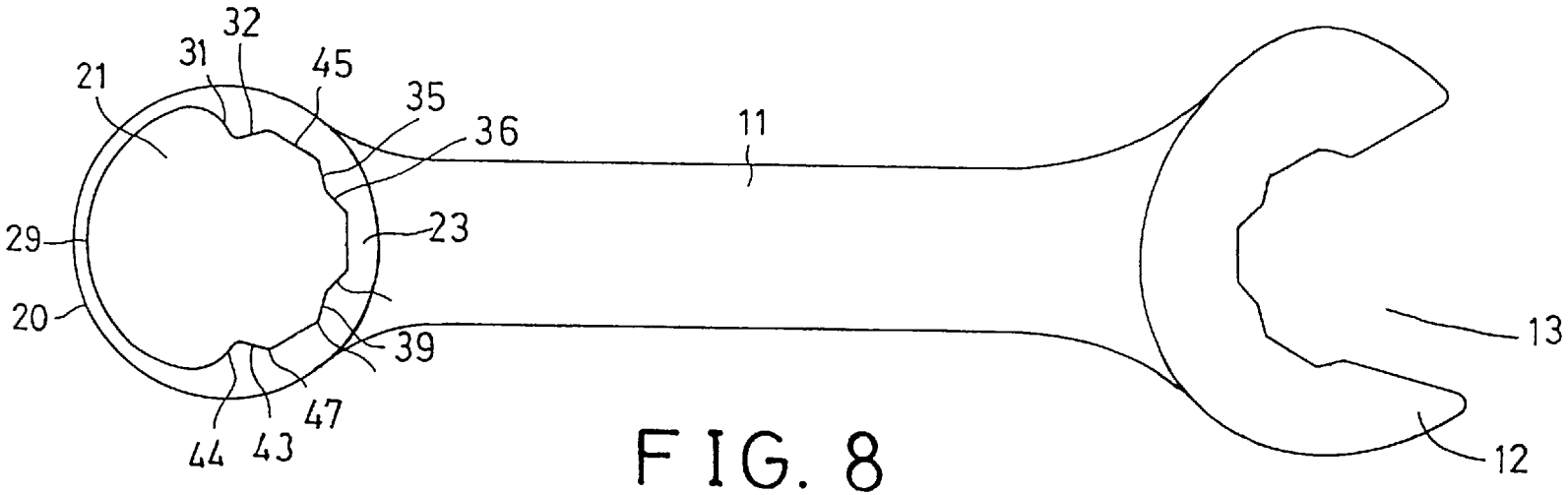
FIG. 8 is a plane view similar to FIG. 2, illustrating the other application of the wrench.
Figure 9:
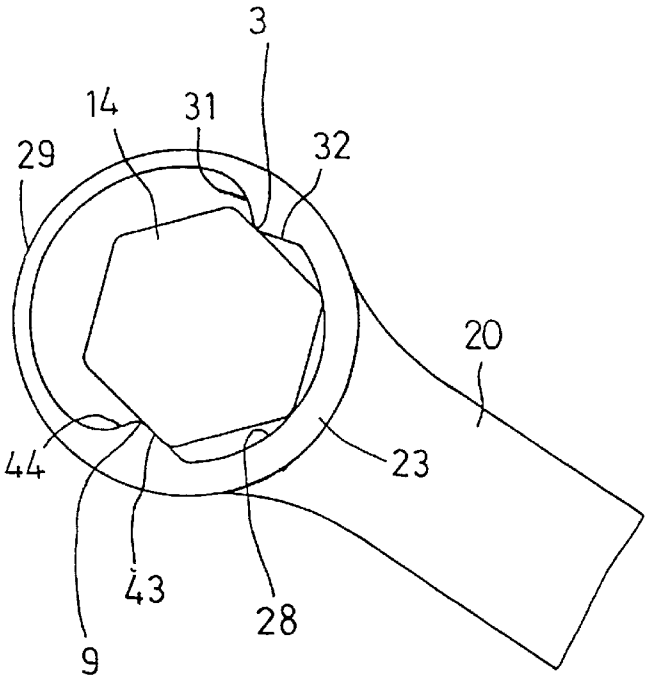
FIG. 9 is a partial plane view illustrating a further application of the wrench.

It is to be noted that, for a hexagonal fastener 14, the surfaces 31, 33, 34, 37, 38, 41, 42, 44 and the cusps 4, 6, 8 may not apply a force against the fastener 14 when the fastener 14 is either driven clockwise (FIGS. 6, 7) or driven counterclockwise (FIGS. 3, 4) by the head 20. The surfaces 33, 34, 37, 38, 41, 42 and the cusps 4, 6, 8 thus may be replaced by three flat surfaces 45, 46, 47 respectively as shown in FIG. 8. Or, alternatively, as shown in FIG. 9, the head 20 includes a curved surface 28 formed in the root portion 23 thereof and having no cusps and flat surfaces formed therein. The head 20 may include only the opposite cusps 3, 9 and the surfaces 32, 43 formed therein, which are good enough to drive the fastener 14 in either the active or the reverse direction. The fastener 14 may also be driven clockwise by the surface 32 and the cusp 9, and may be driven counterclockwise by the surface 43 and the cusp 3.

Accordingly, the wrench in accordance with the present invention includes a number of flat contacting surfaces for engaging with and for driving the fastener and including an enclosed opening for receiving the fastener and for allowing the fastener to be disengaged from the flat contact surfaces and to be rotated relative to the wrench without being disengaged from the wrench.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench for driving a headed fastener and comprising:

an elongated handle including a first end having a head provided thereon, said head including a closed peripheral wall bounding an orifice for receiving a head of a fastener to be driven by said head, said head including at least a first cusp and a second cusp extended inwardly into said orifice, said head further including a first surface formed beside said first cusp and a second surface formed beside said second cusp for engaging with the head of the fastener, and said first cusp and said second surface being located so as to engage the head and drive the fastener in a first direction, and said second cusp and said first surface being located so as to engage the head and drive the fastener in a second direction opposite to the first wherein the orifice is sized so as to enable the first and second cusps and the first and second surfaces to be disengaged from the head of the fastener, thereby enabling relative rotation between the wrench and the head without removing the head from the orifice, wherein said head further includes a third cusp and a fourth cusp extending inwardly into said orifice and located between said first and said second cusps, said third cusp being defined by third and fourth surfaces, said fourth cusp being defined by fifth and sixth surfaces, such that said first cusp, said second surface, said third surface and said fifth surface are located so as to engage the head and drive the fastener in said first direction, and said second cusp, said first surface, said fourth surface and said sixth surface are located so as to engage the head and drive the fastener in said second direction.

2. The wrench according to claim 1, wherein said head further includes a fifth cusp, a sixth cusp and a seventh cusp all extending inwardly into said orifice, said fifth cusp located between said first and third cusps, said sixth cusp located between said third and fourth cusps, and said seventh cusp located between said fourth and second cusps respectively, said fifth cusp, said sixth cusp and said seventh cusp each being defined by a pair of surfaces for engaging with the head and for driving the fastener.

* * * * *